US006895848B1

(12) United States Patent
Svensson

(10) Patent No.: US 6,895,848 B1
(45) Date of Patent: May 24, 2005

(54) DEVICE FOR REMOVING ONE OR MORE LENGTHS OF PAPER FROM A ROLLED-UP PAPER STRIP

(76) Inventor: Karl Gunnar Svensson, Ekenhillsvägen 5 E, S-632 39, Eskilstuna (SE)

( * ) Notice: Subject to any disclaimer, the term of this patent is extended or adjusted under 35 U.S.C. 154(b) by 0 days.

(21) Appl. No.: 09/959,917

(22) PCT Filed: May 18, 2000

(86) PCT No.: PCT/SE00/00989

§ 371 (c)(1),
(2), (4) Date: May 9, 2002

(87) PCT Pub. No.: WO00/74546

PCT Pub. Date: Dec. 14, 2000

(30) Foreign Application Priority Data

Jun. 4, 1999 (SE) ..... 9902064

(51) Int. Cl.[7] ..... A47K 10/36; B65H 19/10
(52) U.S. Cl. ..... 83/649; 225/11; 225/46
(58) Field of Search ..... 83/649, 208, 734; 225/8, 10, 11, 46

(56) References Cited

U.S. PATENT DOCUMENTS

| | | | | |
|---|---|---|---|---|
| 1,016,270 A | | 2/1912 | Johnson | |
| 2,645,543 A | * | 7/1953 | Mancini | 83/649 |
| 3,384,280 A | * | 5/1968 | Summersby | 225/23 |
| 4,192,442 A | | 3/1980 | Bastian et al. | |
| 4,358,169 A | * | 11/1982 | Filipowicz et al. | 225/8 |
| 4,765,555 A | | 8/1988 | Gambino | |
| 4,848,201 A | * | 7/1989 | Urwyler et al. | 83/649 |
| 5,001,952 A | | 3/1991 | Myogadani | |
| 5,131,302 A | * | 7/1992 | Watanabe | 83/649 |
| 5,452,832 A | * | 9/1995 | Niada | 225/11 |
| 5,772,291 A | * | 6/1998 | Byrd et al. | 312/34.22 |
| 6,314,971 B1 | * | 11/2001 | Schneider | 134/56 R |
| 6,412,679 B2 | * | 7/2002 | Formon et al. | 225/10 |

FOREIGN PATENT DOCUMENTS

| | | |
|---|---|---|
| CH | 416002 | 1/1967 |
| DE | 3342921 | 11/1987 |
| DE | 2980708 | 6/1998 |
| FR | 2533124 | 3/1984 |
| SE | 363970 | 11/1974 |
| SE | 511369 | 9/1999 |

OTHER PUBLICATIONS

Patent Abstracts of Japan of Japanese Patent Pub. No. 10230981, dated Sep. 2, 1988, entitled "Taking-Out Device for Stock Roll Paper" (Onda Takatsugu).

* cited by examiner

*Primary Examiner*—Stephen Choi
(74) *Attorney, Agent, or Firm*—Dykema Gossett PLLC

(57) ABSTRACT

A device (1) for extracting one or more paper strip portions (3') from a paper strip rotatably arranged around an axle, preferably rolled around a bobbin, while utilizing an edge surface serving as a tearing edge or a scissor device, belonging to a lid part (6). Adjacent the edge surface (5) and located within or below the lid part (6) is arranged a rotatable counter roller (8), adapted to press against the paper strip (3) with part of its peripheral surface. The counter roller is rotatable by a powered feed roller (7) so that the rotation will extract a paper strip portion (3') past the edge surface. The counter roller (8) is made to press against the paper strip by a spring force. A frontal lid part (6) carries the counter roller (8) and has an edge surface or cutting edge (5).

6 Claims, 2 Drawing Sheets

DEVICE FOR REMOVING ONE OR MORE LENGTHS OF PAPER FROM A ROLLED-UP PAPER STRIP

TECHNICAL FIELD OF APPLICATION

The present invention refers to a device for easy removal of one or more lengths of paper from a paper strip, which is rotatable around a central shaft or axle of rotation and commonly rolled-up around a bobbin, while utilizing an edge surface as a ripping support, in certain cases as part of a shears device.

A device of this kind can advantageously be used as a holder for toilet paper, paper towels or similar, and has been specifically developed for simple use by persons with limited mobility or other physical handicaps.

More specifically, such a device should comprise a roller or wheel, commonly called feed roller, such as an electrically powered roller, the rotation of which can be controlled by a contact means.

PRIOR TECHNICAL STATE OF THE ART

Devices of the kind described in the introduction are earlier known in a great number of embodiments, where one or more lengths of paper can be removed by hand from a rolled-up paper strip.

For less handicapped persons it has been suggested a device which requires gripping the free end of a paper strip, applying a pulling force to the paper strip in a direction away from the rolled-up paper strip or from a holder adapted to the rolled-up strip, to let the rolled-up paper strip rotate around a central axle or central shaft.

The pulled-out length of paper is then torn off by using a serrated edge, belonging to a lid part of said holder.

This lid part is usually designed to extend some distance above and enclosing said rolled-up paper strip.

Similar devices of the kind described and adapted for use by more handicapped persons will exhibit an electric drive and feed mechanism for extracting lengths of the paper strip. Such devices are also known in a number of embodiments.

The following patent publications are now referred to as examples of the prior technical state of the art.

U.S. Pat. No. 4,579,267

Here is described a device to remove one or more lengths of paper from a rolled-up strip of paper, and also described a special means for cutting the paper strip.

Here is described a holder for a roll of paper along with at least one means 11, 14, 15 for feeding the strip of paper to an extracted position 17 at which a device for cutting the paper strip should be possible to activate.

A means 16 for guiding the paper strip is located downstream from the feeding means 11, 14, 15 in order to change the direction of motion of said paper strip 4 to direct it towards said extracted position 17.

Here is described the use of a fixed knife 18 located downstream from the guiding means 16, oriented to face away from the extracted position 17 and towards said means 16, with the knife edge forming an acute angle with said means 16.

FR-A1-2 533 124

Here is shown and described a device of the relevant kind, with opposing rollers which are adapted to feed a strip of paper and with separate means 24 for cutting the strip of paper.

DE-C2-33 42 921

Here is shown a device for extracting a protective paper for toilet seats, with an electrically powered feed roller.

SE-A-363 970

Here is shown a control mechanism for intermittent extraction of a certain length of a paper strip from an extraction device, in which a cutting blade is arranged to move between a passive rest position and a ripping position. A swingable slide 140 is provided with a cutter blade 145 and can be moved by pressure from a cutting position when the paper is cut against a yieldable support, to a closed position when a control lever 170 touches a cam element 162 to close an electric switch 190 which results in a rotation of the cam wheel 160 and feeds another predetermined length of the paper strip from the extraction device, and the cam wheel 160 comprises a second cam element 163, which after a predetermined rotation of the cam wheel 160 closes a stopping switch 185, and at the same time permits repositioning of the lever 170 to a position allowing opening of the switches 190, 185 in turn.

Through the Swedish patent application 9702017-6 is earlier known a device 1 for seriously handicapped persons, adapted for removing one or more lengths of paper strip 3' from a paper strip 3 rotatably located around a shaft 2, preferably rolled around a bobbin, utilizing an edge surface 5 serving as a tearing edge or as a scissor blade, where a counter roller 8 is arranged pressable against a powered feed roller 7 and mounted with springs 9 to the frontal part of a lid 6, and where a first part 21 of a scissor device 20 is also fastened to said frontal part 5.

Here is specially described that said feed roller 7 and said counter roller 8 are horisontally aligned to each other, and that said first part 21 of the scissor device 20 is arranged as a cylinder rotatable by motion of a lever 11, and that said first part 21 of the scissor device 20 in shape of a helical scissor blade is located immediately below said counter roller 8.

DESCRIPTION OF THE PRESENT INVENTION

Technical Problems

Considering that the technical appraisals an expert in the relevant technical field must make to reach a solution for one or more stated technical problems are initially reviews of which actions or sequences of actions might be taken, and secondly a choice of which means are required, and based upon this, the following technical problems should be regarded as relevant in specifying the device according to the present invention.

In view of the prior technical state of the art as described above, it is clearly a technical problem to offer a simple device of the relevant kind, specially adapted for use by persons with limited mobility or similarly handicapped, by specifying a device designed to fill requirements of simple substitution of a complete roll of paper instead of an empty roll, and a simple extraction of a leading length of paper strip past a protected inner feed roller.

It must also be regarded as a technical problem to realize the value of specifying a simple device which also can be regarded as contributing to low paper consumption through its design and function.

It must also be regarded as a technical problem to offer a simple feed function with appropriate design features for keeping the paper strip under tension between the paper roll and the feed roller before extraction of one or more lengths of paper, and for a possibility of simple grasping and tearing off an extracted paper strip.

It is a technical problem to realise the importance of having an efficient feed or extraction function, which will work even if the leading edge of the paper strip should be located some distance below a tearing or ripping edge or a scissor mechanism belonging to a lid part.

It must also be regarded as a technical problem to offer a device of the relevant kind with a simple feed function for the paper strip, with a possibility of operating with only one hand, also when an empty paper roll is to be exchanged for a full paper roll.

It is also a technical problem to realize the importance of using a powered rotatable feed roller adapted to the task mentioned above, and to offer simple extraction of a length of paper strip past a tearing edge or scissor device, as well as the importance of providing a counter pressure roller acting with a suitable pressure against the external surface of the paper strip.

It must also be regarded as a technical problem to realize the importance of making the feed roller rotatable by an electrically controlled motor or similar arrangement.

In addition, it must be regarded as a technical problem to attempt to keep the paper strip tensioned between the paper roll and the feed roller by creating a possibility for part of the unrolled strip of paper to be redirected downwards, where the redirection is to occur in a region located between the rotation axis of the paper roll and the external surface of a full paper roll.

It is also a technical problem to realize the importance of choosing the angle of redirection as an approximately straight angle and of ensuring that the paper strip runs between the feed roller and the counter roller, and of making the paper strip extend downwards past said tearing edge or scissor device by its own weight.

It is also a technical problem to realize the importance and advantage of letting the redirected part of the paper strip be pressed against an edge by the weight of the rolled-up paper strip.

There is also a technical problem to realize the importance and advantage of making said edge be rounded with a radius of curvature between 2 and 20 mm, preferably between 5 and 10 mm such as around 8 mm.

There is also a technical problem to realize the importance of having a counter pressure roller or the center axis of a counter pressure roller adapted to be located relative to a horizontal plane through the center axis of the feed roller, above said horizontal plane.

There is also a technical problem to realize the importance of choosing said feed roller with a diameter slightly larger than the diameter of the counter roller, with the ratio between the diameters chosen between 2,0 and 1,2, preferably around 1,3.

There is also a technical problem to realize the importance of letting said tearing or ripping edge be oriented in a direction close to a horizontal plane, and preferably located below the counter roller and at a distance corresponding to the diameter of the counter roller.

Within the frame of the invention there is also a possibility to employ a detector, located close to the counter roller and adapted to activate a feed mechanism during a preset time when approached by a hand.

There is also a technical problem to realize the importance of making said detector refer to the paper edge, at that edge where tearing of the paper strip is started.

The invention also indicates the possibility of utilizing a scissor device adapted for cutting of the paper strip.

Said scissor device can be activated by hand or by an electric activating impulse.

It is a technical problem to realize the importance of letting a non-powered counter roller facing the feed roller be pressed into contact with the paper strip by a spring device attached to a front lid part, and the importance of providing the peripheral surface of the feed roller or the counter roller with a high friction pattern or layer.

It is also a technical problem to realize the importance of designing said center shaft or said feed roller with a larger diameter in its central region than in regions closer to the ends, in order to let this design cause centered extraction motion of a length of paper from the paper roll.

It is also a technical problem to realise that any power sources needed for powering of a feed roller, such as an electric motor, should be located within or adjacent to the sidewalls, or alternatively that the motor could be centrally located within a tubular item supporting the feed roller.

There is also a technical problem in realizing the advantage, in case the device is battery powered, of reserving space for the batteries needed in the sidewalls or in said central shaft, central bar or tubular item.

It should furthermore be regarded as a technical problem to realize the importance of making the required electrical circuits control the feed roller in such a way that it will extract one piece of paper strip at a time, preferably all pieces with the same length.

There is also a technical problem to realize the importance and advantage of using an easily removable lid as a front wall, and letting a counter roller of the feed mechanism be attached to the lid.

Solution According to the Invention

The present invention starts with a device adapted to removing one or more lengths of paper from a roll of paper rotatably arranged around a central axis, preferably wound on a bobbin, while using an edge surface belonging to a lid as a tearing edge or a scissor device, also including a powered feed roller for extracting the strip of paper.

At such a device, the present invention suggests that a part of the unrolled strip of paper should be redirected downwards in a region between the center or rotatory axis of the paper roll and the peripheral surface of a full roll of paper, that said redirection is chosen as an approximately right angle, that the strip of paper is adapted to run between the feed roller and the counter roller, and that the paper strip is adapted to extend downward beyond said tearing edge or scissor device by its own weight.

As a further development of the invention it is suggested that the redirected part of the strip be pressed against an edge by the weight of the rolled-up paper strip, where that edge is rounded with a radius of curvature between 2 and 20 mm, preferably between 5 and 10 mm.

It is further suggested that in relation to a horizontal plane through the center axis of the feed roller, a central axis belonging to said counter roller be located above said horizontal plane.

Said feed roller is chosen with a diameter slightly larger than the diameter of the counter roller, and with a ratio between diameters chosen between 2 and 1,2, preferably around 1,3.

Said tearing edge is further oriented in a direction corresponding to a horizontal plane, where said tearing edge is located below the counter roller at a distance corresponding to the diameter of the counter roller.

The invention also describes the use of a detector applied close to the counter roller and adapted for activation of paper feed means during a predetermined time or for extracting a predetermined length, when approached by a hand.

It is further described that said detector should be related to an edge of the paper, specifically that edge from where the tearing of the paper begins.

The invention also describes the use of a scissor device, adapted to cutting the paper strip, where the scissor device is activated by hand or by an electric activating impulse.

In addition, it is described a rotatable feed roller, adapted to be in contact with the paper strip with part of its peripheral surface, rotatably powered to extract a certain length of paper past said tearing edge or scissor device through said rotation, and with said feed roller arranged to contact the paper strip with a force derived from a tension in the paper strip and said counter roller.

As further embodiments within the frame of the present invention, are described that said feed roller may be rotatable by an electrically controlled motor or similar.

It is further described that the counter roller should be pressed against the paper strip and the feed roller by means of a spring device fastened to the lid part.

It is also described that the peripheral surface of the feed roller should be provided with or machined to display a high friction surface, and that said feed roller or shaft should have a slightly larger diameter in its central region than in regions closer to the ends.

As an optional design is described that the motor can be located within the feed roller itself.

It is also described a possibility to let the motor be powered by batteries, in which case the batteries can be located in or adjacent to the sidewall.

Finally, it is described that the feed roller can be provided with control circuits for feeding paper strips of equal and predetermined length.

Advantages

The advantages which can be regarded as characteristic for a device according to the present invention are, that it offers conditions for a simple device, usable even for persons with mobility handcaps, for extracting one or more paper strips from a rolled up and rotationally arranged paper roll.

It has also been shown possibilities for extracting paper strips of a predetermined length by means of elektronic circuits.

The invention also offers a possibility of replacing an empty paper roller with a full paper roller in a simple way by removing or folding out of the way a frontal piece or lid belonging to the paper holder to make the inner region of the holder accessible, whereafter the empty paper roll is removed and a full paper roll is positioned in a pocket or trough shaped to fit the roll, and the outermost part of the paper strip is caused to fall down over a feed roller. The frontal piece is then closed towards the paper roll and an extracted paper strip. The frontal piece should be provided with a counter roller which will press the paper strip against the feed roller.

Additionally there are described means to ensure a tensile stress in the paper strip by redirecting the extracted paper strip downward in a region between the rotational shaft assigned for the paper roll and the outer surface of a full paper roll, before the paper strip passes between the feed roller and the counter roller, whereafter the paper strip will extend downward past a tearing edge or a scissor device by its own weight.

A detector assigned to one edge of the paper strip will activate the feed roller to extract a paper strip when approached by a hand.

What is regarded as especially characteristic for a device according to the invention is specified in the characterizing part of the first claim following.

BRIEF DESCRIPTION OF THE FIGURES

One suggested embodiment, exhibiting the characteristics which are significant for the present invention, is to be closer described as follows, with reference to the appended figures, where.

DESCRIPTION OF THE EMBODIMENT DESCRIBED HERE

Figure 1:
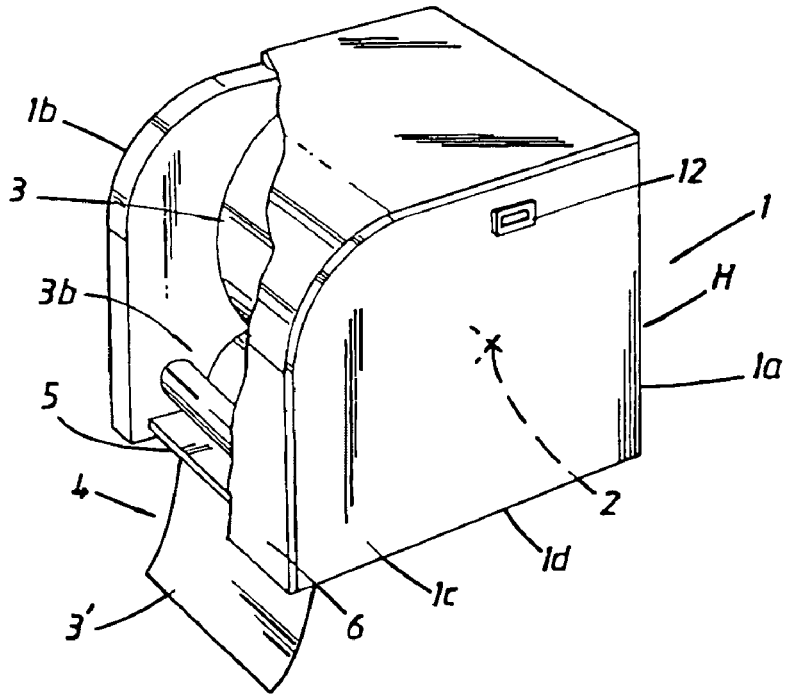
FIG. 1 shows a perspective view, partly sectioned, of a device with a paper roll in place and a partially extracted paper strip.

With reference to FIG. 1, the perspective view shows a device 1 adapted for removal of one or more paper strip portions 3' from a paper strip 3 rotatably arranged around a shaft 2 as a paper roll, where the paper strip 3 can be rolled around a bobbin.

The paper strip is shown as wound around a centrally located bobbin 3*a*.

A holder of paper roll 3 and other parts consists of a base part H1 and a lid 6. A roll support surface 11 is contained in the base part H1 and includes a downwardly-extending portion 11*a*, trough portion 11*b*, and a reverse-curved forward edge portion 11*c*.

One or more paper strip portions 3' can then be extracted from a paper roll to be unrolled, and by using an edge surface 5 of the lid part 6 as a tearing edge, the outer portion 4 can be torn off.

The edge surface 5 is made to extend for a length "a" below the line where said unrolled paper strip 3 is squeezed or held 3" between a feed roller 7 and a counter roller 8.

Adjacent to said edge surface 5 inside the lid part 6 is located a rotatable indirectly powered counter roller 8.

Said feed roller 7 is made to have its peripheral surface 7*a* in contact with the paper strip 3. The feed roller 7 is rotatable and intermittently powered, to extract one or more paper strip portions 4 past said edge surface 5 by this rotation.

The counter roller 8 can be fixedly journalled to the lid part 6 with a bracket. Its peripheral surface could then be made very elastic.

Figure 2:
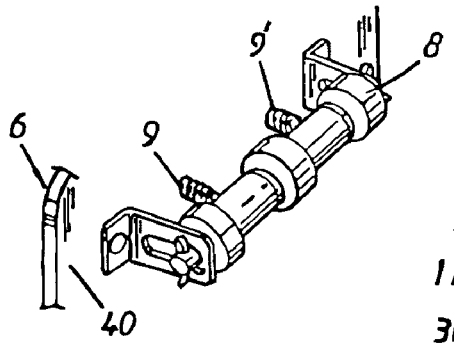
FIG. 2 shows in another perspective view a lid related frontal piece with a spring loaded counter roller applied to it.

The counter roller 8 is in FIG. 2 shown to have its peripheral surface in contact with the paper strip, with a force determined by two spring devices 9, 9', with a line of action 3" in a region 3*b*, acting towards the feed roller 7 which is fixedly journalled relative to the base part H1 of the holder.

It is within the frame of the invention to make said feed roller 7 rotatably powered by a feed mechanism. Such a mechanism may comprise a mechanical springwork or corresponding, controllable by a control lever.

However, the embodiment described here illustrates the feed mechanism as a mechanism powered by an electrically controlled motor. This electric motor 70 may be located within or attached to a wall 1*a*, 1*b*, 1*c* or 1*d*, such as the rear wall 1*a* shown, and made to rotate the feed roller 7 by means of angular gears or a belt transmission 71. It may alternatively be located inside the roller 7.

It is also shown that said edge surface 5 should, relative to the counter roller 8, be located at a determined distance "a" below the contact line 3", irrespective of the thickness of the paper roll 3, which criterion poses special rules for locating the counter roller 8 in relation to the hinge axis 10 or corresponding of the lid part 6.

The peripheral surface 7*a* of the feed roller 7 may also be provided with or machined to have a high friction surface, by corrugation or by rubber tires.

Said counter roller 8 and/or feed roller 7 could preferably be given a larger diameter in the central region than in regions closer to the ends, with a difference between 1 and 5 mm.

A control means 12 for connecting or disconnecting an electric current can preferrably consist of an electric switch, which when it is connected activates the power of the feed roller 7 to extract a paper strip portion 3', preferrably in combination with a circuit determining the length of the extracted strip either to a constant value or a value corresponding to the length of time during which the switch 12 or the contact is operated.

An alternative embodiment has a timer circuit or corresponding, letting a momentary operation of the switch 12 activate the feed roller 7 to extract a paper strip portion of a predetermined length.

In case the device is made for battery power, it would be suitable to design the walls 1*a*, 1*d* so that they may contain not only batteries but other necessary electric devices for powering the feed roller 7 as said above.

It is also among the possibilities to insert the batteries inside the feed roller in a similar way.

As has been briefly described above, the counter roller 8 can be attached to a frontal lid part 6 by means of springs 9,9' and pressed against the powered feed roller 7 by the proper weight of the lid part.

Figure 3:
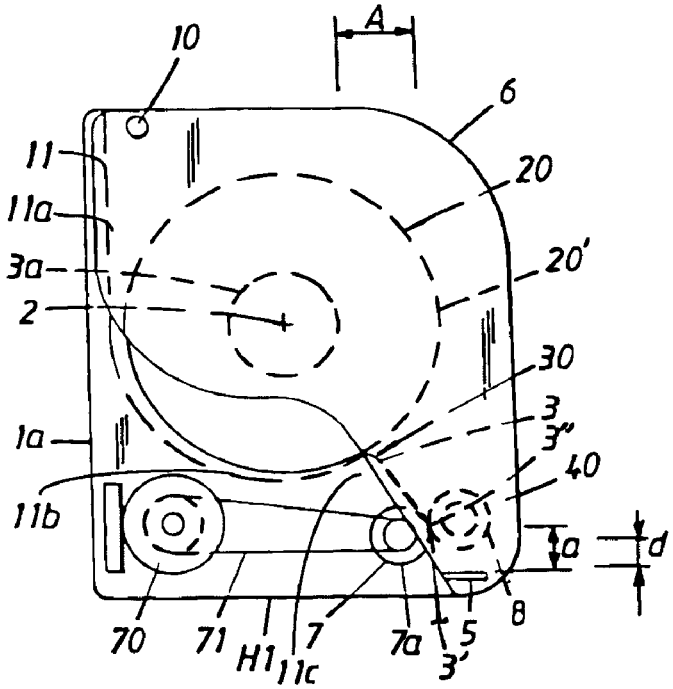
FIG. 3 shows in a lateral view, partially sectioned, the same device as FIG. 1.

With reference to FIG. 3 is shown that a portion 30 of said extracted paper strip 3 is made to be redirected downwards in a region -A- located between the central shaft 2 and the peripheral surface 20 of a full paper roll. More specifically, this refers to a point 20' belonging to the peripheral surface.

This specified region -A- can be adapted to comprise maximally around 50% of the radius of the paper roller 3, more specifically 20–30%, centered around said portion 30.

The redirecting occurs more or less along the reverse-curved forward edge portion 11*c*.

This edge is chosen to encompass approximately a right angle, or between 70 and 120 degrees, and the portion 32 of the paper strip is adapted to pass between the feed roller 7 and the counter roller 8, and the paper strip is chosen so that it can extend downward past said tearing edge 5 or scissor device.

The redirected portion 30 is pressing against the reverse-curved forward edge portion 11*c* by the weight of the rolled-up weight of the paper roll.

Said reverse-curved forward edge portion 11*c* is rounded with a radius between 2 and 20 mm, preferably between 5 and 10 mm, such as 8 mm.

It is also possible to treat the surface of the reverse-curved forward edge portion 11*c* facing the paper strip, to give it a structure with high friction against the paper strip when this is moving.

The redirected portion 30 is pressed against the reverse-curved forward edge portion 11*c* by the proper weight of the paper roll 3, since the longitudinal part of the pocket or trough 11*b* is given a smaller radius of curvature than the peripheral surface of a full paper roll.

As the diameter of the used paper roll 3 gradually decreases, the peripheral surface 20 will gradually approach the curvature of the pocket 11*b* until they coincide.

During this interval there will always be a tensile force in the strip 34 below the redirected portion 30.

A central axis 8' belonging to the counter roller 8 is arranged to be located in relation to a horizontal plane through the central axis 7' of the feed roller 7 at a distance -b- above said horizontal plane.

The distance -b- is here chosen to be smaller than the radius of the counter roller 8. The slope angle between the two axes 7', 8' should be chosen between 10 and 50 degrees, preferably from 15 to 25 degrees.

Said feed roller 7 is made with a diameter chosen to be slightly larger than the diameter of ther counter roller, where the ratio is chosen to be between 2,0 and 1,2, preferably around 1,3.

Said tearing edge 5 is oriented in a direction approximately in a horizontal plane.

Said tearing edge 5 is located below the counter roller 8 with a distance -d- between the peripheral surface 8*a* of the counter roller and the tearing edge or scissor device approximating the diameter of the counter roller or slightly less.

The invention further describes the use of a IR-detector 40 and this should be applied adjacent to the counter roller 8 and adapted to activate a paper feed mechanism during a predetermined time when approached by a hand.

Suitable circuits for this purpose are well known and need no detail description.

Said detector 40 is related to a paper edge, specifically that edge from which tearing of the paper strip begins.

Instead of a tearing edge 5 it is obviously possible to use a scissor device for cutting or shearing the paper strip.

The scissor device may then be activated by hand, or electrically activated by an activating impulse, through electric circuits not shown in the figure.

Figure 4:
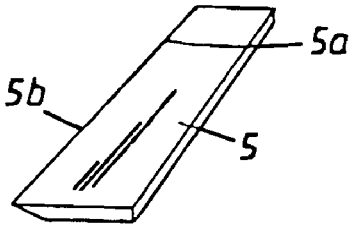
FIG. 4 shows a perspective view of a tearing edge according to the invention.

Referring to FIG. 4, this shows a perspective view of a tearing edge 5 with one longitudinal surface 5*a* taper ground to exhibit a sharp edge 5*b*. In a known way, the tearing edge 5 is attached to a bracket on the lid 6 or between the sidewalls 1*b*, 1*c*.

Figure 5:
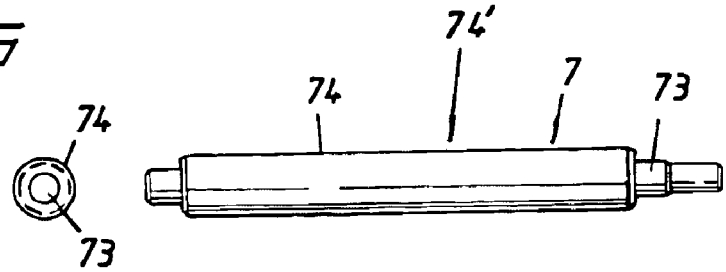
FIG. 5 shows a lateral view and an end view of a feed roller according to the invention.

FIG. 5 shows in a lateral view and an end view a feed roller 7, which may consist of a shaft 73 and a rubber socket 74 affixed to the shaft, with a central region 74' which may have a larger diameter than the regions of the cover which are closer to the ends.

Figure 6:
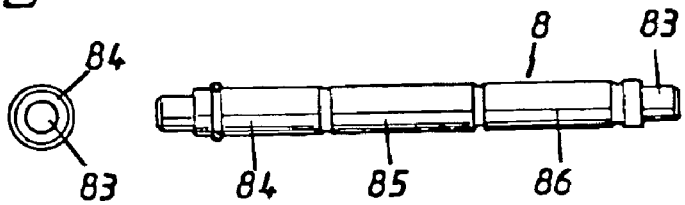
FIG. 6 shows a lateral view and an end view of a counter roller according to the invention.

Referring to FIG. 6, this shows in a lateral view and in an end view a counter roller 8, which also comprises a shaft 83 and a plurality of rubber sockets 84, 85, 86.

Said sockets may consist of rubber material with an elastic outer layer and a harder core.

Figure 7:
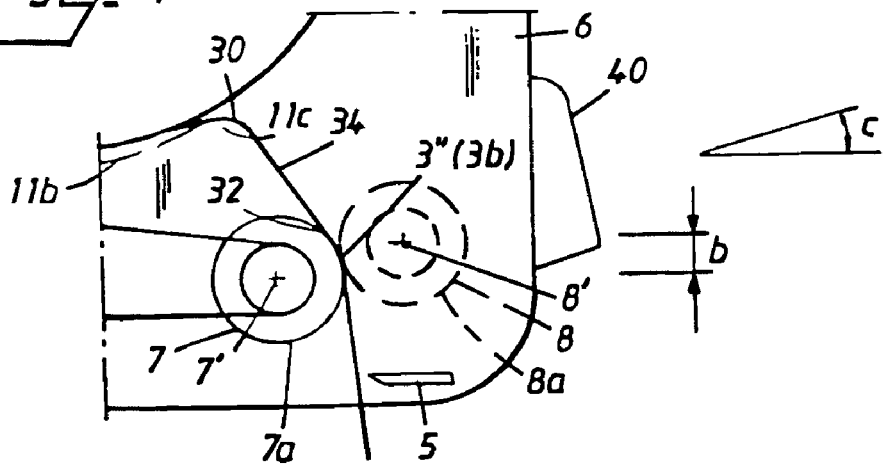
FIG. 7 shows in an enlarged scale a part of the device shown in FIG. 3.

The detector, or rather the place for a detector, may be located on the inside of the lid 6 as shown in FIG. 3, but it may alternatively located on the outside of the lid 6 as shown in FIG. 7.

The invention is obviously not restricted to the embodiment described above, but it may be modified within the frame of the invention as described in the following patent claims.

What is claimed is:

1. A dispenser for dispensing segments of a paper strip unwound from a paper roll, said dispenser comprising:

a base which defines a rear wall; a bottom wall; a roll support surface located forwardly of the rear wall, said roll support surface including a downwardly extending rear portion, a forwardly-extending trough portion, and a reversed-curved forward edge portion, said reverse-curved forward edge portion having a radius of curvature of between 2 and 20 mm; and a drive roller located beneath and forwardly of the reverse-curved forward edge portion, and a lid which is pivotally connected to said base so as to be pivotable between a upper position wherein a paper roll can be placed on the roll support surface of said base and a lower position wherein the roll support surface with paper roll thereon is covered, said lid including a counter roller and a cutting means, said counter roller and said cutting means being attached to said lid such that, when said lid is pivoted to said lower position, said counter roller is pressed against said drive roller and said cutting means is located beneath said counter roller, said counter roller having a diameter that is smaller than a diameter of said drive roller and said cutting means being positioned a distance from said counter roller which is essentially equal to said diameter of said counter roller, a paper strip unwound from a paper roll on said roll support surface passing over said reverse-curved forward edge portion, downwardly through a nip between said drive roller and said counter roller, and past said cutting means for cutting into segments.

2. A dispenser according to claim 1, including a detector located near the feed roller for activating a feed mechanism for a predetermined time when approached by a hand.

3. Device according to claim 2, wherein said counter roller is attached to said lid such that when said lid is in said lower position, a center axis of said counter roller is above a horizontal plane that extends through a center axis of said drive roller.

4. A dispenser according to claim 1, including an electric motor for the feed roller.

5. A dispenser according to claim 1, wherein the feed roller functions to extract paper strip portions with a predetermined length by means of electronic circuits.

6. A dispenser according to claim 1, wherein said radius of curvature is between 5 and 10 mm.

* * * * *